US010129638B2

(12) United States Patent
Larsen et al.

(10) Patent No.: US 10,129,638 B2
(45) Date of Patent: Nov. 13, 2018

(54) MICROPHONE FOR A HEARING AID

(71) Applicant: Oticon A/S, Smørum (DK)

(72) Inventors: Martin Larsen, Smørum (DK); Jesper Pedersen, Smørum (DK); Rasmus Andersson, Cupertino, CA (US); Morten Fuglsang-Philip, Smørum (DK); Gorm Dannesboe, Smørum (DK); Mario Stoll, Berne (CH)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 15/409,860

(22) Filed: Jan. 19, 2017

(65) Prior Publication Data

US 2017/0208390 A1 Jul. 20, 2017

(30) Foreign Application Priority Data

Jan. 20, 2016 (EP) ..... 16152000

(51) Int. Cl.

| | |
|---|---|
| ***H04R 25/00*** | (2006.01) |
| ***H04R 1/32*** | (2006.01) |
| ***G10K 11/00*** | (2006.01) |
| ***H04R 19/04*** | (2006.01) |
| ***H04R 31/00*** | (2006.01) |
| ***H04R 19/00*** | (2006.01) |
| ***H04R 19/01*** | (2006.01) |

(52) U.S. Cl.
CPC ..... *H04R 1/326* (2013.01); *G10K 11/004* (2013.01); *H04R 19/005* (2013.01); *H04R 19/016* (2013.01); *H04R 19/04* (2013.01); *H04R 31/006* (2013.01); *H04R 25/402* (2013.01)

(58) Field of Classification Search
CPC .... G10K 11/004; H04R 1/326; H04R 19/005; H04R 19/016; H04R 19/04; H04R 25/402; H04R 31/006
See application file for complete search history.

(56) References Cited

U.S. PATENT DOCUMENTS

2014/0112509 A1* 4/2014 Lafort ..... H04R 25/402 381/322

FOREIGN PATENT DOCUMENTS

| | | | |
|---|---|---|---|
| EP | 2 552 128 | A1 | 1/2013 |
| WO | WO 2011/015674 | A1 | 2/2011 |
| WO | WO 2012/139230 | A1 | 10/2012 |

* cited by examiner

*Primary Examiner* — Brian Ensey
(74) *Attorney, Agent, or Firm* — Birch, Stewart, Kolasch & Birch, LLP

(57) ABSTRACT

A hearing aid includes a microphone unit arranged in a hearing aid housing. The microphone unit is oriented in the housing relative to a microphone inlet element to cause a pressure equalization that allows acoustic cancellation of vibrations in the microphone unit.

20 Claims, 4 Drawing Sheets

MICROPHONE FOR A HEARING AID

FIELD

The present disclosure relates to an electronic device, such as a hearing aid. The electronic device comprising a microphone unit, which is arranged in the housing so as to optimize the sensitivity of the microphone unit towards changes in the environment, potentially causing the housing to be influenced by vibrations.

BACKGROUND

Hearing devices, such as hearing aids, provided for aiding hearing impaired people in hearing, comprises one or more microphones. The one or more microphones is configured to receive an audible sound signal, typically a speech signal. The sound signals are picked up by one or more sound inlets of the microphone and are within the microphone transferred to an electric signal. The electric signal is transferred to an amplifier, which amplifies the electric signal information to such a level, at which a hearing impaired is able to hear the sound. The amplified sound is transmitted to a receiver, which transduces the electric signal into an audible signal suitable for human hearing and transmits it to the eardrum of a user.

Different kinds of microphone types exist, and common to all microphone types (such as condenser microphones, e.g. electret and MEMS type microphones) is that such microphone units are sensitive to displacement, movement and vibrations as well as the sound pressure level (SPL) to which they are exposed. Imperfections in the microphone performance may arise, when microphones are exposed to environmental changes within the hearing aid device, such as vibrations caused by the receiver.

One factor causing imperfections of microphones in hearing aids is often due to the arrangement of a receiver in close proximity to a microphone. When a receiver emits amplified sound signals small vibrations easily occurs. Such vibrations are distributed throughout the hearing aid shell and internal parts, and are likely to influence the mechanisms of the microphone. The vibration causes the microphone to create an unwanted electrical signal, which gets amplified and transmitted by the receiver to the ear of a user. The amplified signals due to vibrations are thus unwanted signals which are transmitted to the ear drum of a user and which easily forms part of an acoustical feedback loop causing unwanted and annoying sound signals for a hearing aid user.

In hearing aid applications, the sensitivity of microphones to vibrations is a limiting factor in view of the maximum gain that can be applied in hearing instrument platforms. When applying an insertion gain to compensate for the normal amplification provided by the ear structure of a human, this gain factor may from these microphone imperfections unintentionally enhance unwanted signals not forming part of the audible signal of interest. For avoiding at least some of these microphone imperfections, hearing aid designs carefully take into consideration the mounting and arrangement of the receiver and the microphone in relation to each other.

Accordingly, it is of interest to compensate for the sensitivity of the microphones to vibrations arising e.g. in a hearing aid housing structure. Current solutions, such as disclosed in EP2552128 solves the vibration sensitivity problem by using a microphone construction with two diaphragms, such that three chambers are provided in the microphone construction. The two diaphragms are arranged so as to move in opposite directions when the microphone construction is moving downwards or upwards in view of mechanical vibrations. However, this construction requires a somewhat complex microphone construction for the vibrations to be cancelled out.

Accordingly, there is a need to provide a solution that addresses at least some of the above-mentioned problems. At least there exist a need to provide alternative and suitable microphone arrangements in a hearing aid, which distinguishes the contribution from vibrations.

SUMMARY

A solution is in an embodiment according to the disclosure, provided by an electronic device, comprising a housing having an outer wall enclosing a microphone unit, the outer wall separating the microphone unit from an environment or the electronic device. The microphone unit comprises a first chamber having a first volume and a second chamber having a second volume, where a first inlet opening is arranged in the first or second chamber, and a movable element separates the first and second chamber. Furthermore, a microphone inlet element is connected to the first chamber or the second chamber at the first inlet opening and to the outer wall of the housing at a second inlet opening, where the microphone inlet element is configured to guide sound from the environment of the electronic device to the microphone.

According to an embodiment of the disclosure, a microphone unit orientation is defined by a first vector perpendicular to the movable element and extending in a direction from the movable element to the first inlet opening, and a microphone inlet element orientation is defined by a second vector extending in a direction from the first inlet opening to the second inlet opening. Accordingly, the microphone unit and the microphone inlet element, are arranged in the housing so that the second vector has a component in a direction opposite to the first vector.

Such orientation of the microphone unit vs. the inlet element allows for a cancellation of an in-build microphone vibration sensitivity when the microphone unit is under influence by an acceleration of the housing of the electronic device. Accordingly, a construction and arrangement of a sound inlet and orientation thereof in combination with a microphone unit orientation, where the two units are arranged in accordance with claim 1 is found to cancel out an in-build microphone vibration sensitivity.

That is, when for example a receiver of the electronic device creates vibrations throughout the housing, the microphone unit inside the housing starts to vibrate accordingly. Such vibrations causes a pressure build-up inside the microphone unit. The pressure build-up inside the microphone unit arises across a movable element, which are susceptible for such pressure differences. The vibrations cause the movable element to move in a direction towards and away from a fixed element of the microphone, whereby a voltage may be created resulting in an undesired sound output from the microphone unit. The pressure build-up in the microphone due to vibrations defines a vibration sensitivity of a microphone, which microphone vibration sensitivity can be found as a value in dB SPL/g in microphone unit datasheets of microphone suppliers The microphone vibration sensitivity is efficiently cancelled out by orientating the microphone unit and the inlet element as previously described. By this arrangement, the pressure build-up in the inlet element, having a specific orientation in comparison to the microphone unit, due to this orientation, is of opposite sign to the pressure build-up inside the microphone unit. Thus, a resulting force from the two pressure build-up in the inlet element and the microphone unit will act on the movable element (i.e. a membrane also defined as a diaphragm), with opposite directed forces so as to keep the movable element in its initial non-moving state. Accordingly, the cancellation of vibrations according to the disclosure is achieved by an acoustic cancellation in the form of a pressure equalization, where no subsequent signal processing by a signal processor is needed to avoid the contribution arising from vibrations of the microphone unit, due to movement thereof in the e.g. a hearing aid housing. Accordingly, only one microphone is needed together with an air column arranged in a relation to each other as described herein. Thus, a more simple vibration cancellation is achieved, which substantially does not require a two-microphone setup to cancel out the vibrations.

In an arrangement of the microphone unit and the inlet element according to embodiments of the disclosure, the microphone unit and the microphone inlet element are arranged relative to each other so that contributions from the microphone unit and the microphone inlet element, respectively, to a vibration sensitivity of the microphone, when located in said electronic device, are substantially equal but of opposite sign. The term "contribution" should be construed in a broad sense, and especially with reference to contributions arising from a pressure build-up in the microphone unit and the inlet element. Thus the different pressure building up in the inlet element and the microphone unit, will act as a force contribution to the movable element. When these contributions are of equal size but of opposite signs, the net forces acting on the movable element allows the movable element to be static, i.e. the movable element stays in place during vibrations.

In an embodiment of the disclosure, the electronic device may be designed such that the second volume of the second chamber may be larger than the first volume of the first chamber. By this arrangement, an optimal in-build microphone sensitivity may be achieved. By the provision of a larger back volume, the sensitivity of a pressure change increases, i.e. a high pressure sensitivity is achieved. As a result, a larger back volume allows for a better signal-to-noise ration (SNR) of the microphone unit, while at the same time improving the low frequency response of the microphone unit. Thus, the microphone unit may be provided with a first smaller volume, also defined as the front volume and a larger second volume, typically known as the back volume. The larger back volume is in this embodiment used since it provides for an optimal microphone performance.

In an embodiment, the first inlet opening is arranged in the front volume of the microphone unit. This allows for a high resonance frequency which leads to a substantially flat frequency response allowing for a more accurate reproduction of sound and an improved microphone.

However, it should be apparent that the first and second volumes could be of equal sizes, and that the first inlet opening may be arranged in the second volume.

In an embodiment, the microphone unit may further comprise a fixed element, arranged in the microphone unit in one of the first or second chamber substantially parallel to the movable element. The fixed element may be suspended in the microphone unit in any suitable way. The fixed element may be construed as an element which are situated in the microphone unit in order to assist in creating a capacity effect of the microphone unit. Thus, the fixed element may be construed broadly as an element which comprises the property of a capacitive element and/or which together with the movable element creates a capacitive effect.

Accordingly, in an embodiment according to the disclosure, the movable element and the fixed element forms a capacitor within the microphone unit. The capacitor creates a voltage which are transmitted to an integrated circuit of the microphone unit, where the electrical signal are processed in order to provide an amplified signal to be transmitted to a receiver of the hearing aid.

In an embodiment of the disclosure an air gap may be defined between the fixed element and the movable element, so that a pressure difference across the movable element forces the movable element to move towards and away from the fixed element. The air gap between the movable element and the fixed element allows the movable element to act as a spring moving towards and away the fixed element, whereby a capacitive effect is achieved. The air gap may be provided in any suitable way and known way.

In an embodiment, the microphone unit may be an electret-type or MEMS-type microphone, wherein the movable element is a diaphragm and the fixed element is construed as a back plate or similar charged back plate element, such as a charged element across which a charge may be applied.

In the electret-type microphone, the back plate may hold a static charge so that a voltage is created across the back plate when a pressure difference arises across the diaphragm. In the MEMS-type microphone the voltage across the back plate is actively generated by an applied voltage applied to the microphone unit.

In an embodiment according to the disclosure, the microphone inlet element is dimensioned with a height. The height is defined as a distance from the first inlet opening to the second inlet opening. By providing an inlet element with a height, the microphone unit may be positioned a distance from the outer walls of the housing, where the second inlet opening is arranged. This allows for more flexibility in view of the placement of the microphone unit inside the electronic device.

Accordingly, the inlet element may be formed as a tube or pipe element, which may be provided with any suitable geometrical cross-section, such as rectangular, oval, round, triangular etc. The inlet element may be made from e.g. plastic or any other suitable material, which may also be biocompatible.

When applying an inlet element with a height, the pressure building up in the inlet element should be taken into account in order to get an optimal vibration sensitivity cancellation.

Therefore, in an embodiment according to the disclosure, the height of the microphone inlet element may fulfill the following equation:

$$h = \frac{p_{inlet}}{rho * a_z},$$

where $p_{inlet}$ is the desired pressure build-up in the inlet element, rho is the density of air and $a_z$ is an environmental acceleration acting on the housing. By using this equation, the inlet height may be designed such that the pressure build-up in the inlet element $p_{inlet}$, corresponds to the pressure build-up in the microphone unit as a result of the microphone sensitivity. Thus, when knowing the in-build microphone unit vibration sensitivity in dB SPL/g, this value may be converted to Pa/g, i.e. $P_{vibsens}$(Pa/g)=$p_{inlet}$(Pa/g), and the optimal height of the inlet element for a certain microphone unit, having a known or measurable microphone vibration sensitivity, may be calculated. In addition to the equation defined above, a pressure, $p_{surface}$, of the outer surface of the housing should be taken into account when calculating $p_{inlet}$. Accordingly, to obtain a sufficient cancellation, it is relevant that the inlet construction is dimensioned in accordance with the above definitions.

In an embodiment of the disclosure, the height of the inlet element is therefore dimensioned such that the contribution from the microphone inlet element to the vibration sensitivity, respectively, of the microphone is equal to, but of opposite sign to the contribution from the microphone unit.

In a second aspect of the disclosure, a method for designing an electronic device optimized for vibration cancellation is disclosed. The effects and advantageous already described in relation to the electronic device according to embodiments of the disclosure does in a similar manner apply to the method.

In more detail, the method comprising the steps of:

i) providing a housing having an outer wall, ii) enclosing a microphone unit in said housing, the outer wall separating the microphone unit from an environment or the electronic device, and the microphone unit comprising a first chamber having a first volume; a second chamber having a second volume; a first inlet opening being arranged in the first or second chamber; a movable element separating the first and second chamber;

iii) connecting a microphone inlet element to the first inlet opening and to the outer wall of the housing at a second inlet opening, wherein the microphone inlet element is configured to guide sound from the environment of the electronic device to the microphone unit; where a microphone unit orientation is defined by a first vector perpendicular to the movable element and extending in a direction from the movable element to the first inlet opening; and a microphone inlet element orientation is defined by a second vector extending in a direction from the first inlet opening to the second inlet opening;

iv) arranging the microphone unit and the microphone inlet element in the housing so that the microphone unit and the microphone inlet element, are arranged in the housing so that the second vector has a component in a direction opposite to the first vector.

Thus in an embodiment according to the method the inlet element has an optimal height, defined as the distance from the first inlet opening to the second inlet opening, the height fulfilling:

$$h = \frac{p_{inlet}}{rho * a_z},$$

where $p_{inlet}$ is the desired pressure build-up in the inlet element, rho is the density of air and $a_z$ is an environmental acceleration acting on the housing.

Accordingly, the method further comprises the step of v) calculating the optimal height of the inlet element, the optimal height being defined by a height which provides a pressure in the inlet element that are equal but of opposite sign to the vibration sensitivity of the microphone unit when located in said electronic device.

As is apparent from the disclosure, the microphone unit according to the method should be construed to comprise any feature in combination or alone as described in relation to the electronic device.

As is apparent throughout the disclosure it should be understood that the electronic device may preferably be a hearing aid.

Accordingly, the electronic device may further comprise a receiver, battery or other relevant components for use in hearing aids.

In addition, the electronic device, may in an embodiment comprise one or more microphone units, arranged in the electronic device in accordance with the previously described embodiments.

Accordingly, two inlet elements may also be arranged in the electronic device, where the inlet elements are arranged to be connected to one or more microphone units, respectively according to the arrangement disclosed herein.

In addition, the electronic device may be a hearing aid suitable for arrangement fully or partially in the ear canal of a user, where the one or more microphones in use of the hearing aid are situated in the ear canal of a user. However, the microphone unit and inlet element arrangement are also suitable for use in a behind the ear unit.

It should be noted that throughout the disclosure a microphone unit should be understood to be a structure having e.g. a shell, which encloses a diaphragm, a back plate and other signal processing means, which is relevant for transforming an acoustic signal into an electric signal. The microphone unit structure is arranged in a hearing aid shell, which also encloses other hearing aid components.

Accordingly, the hearing aid is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 3:
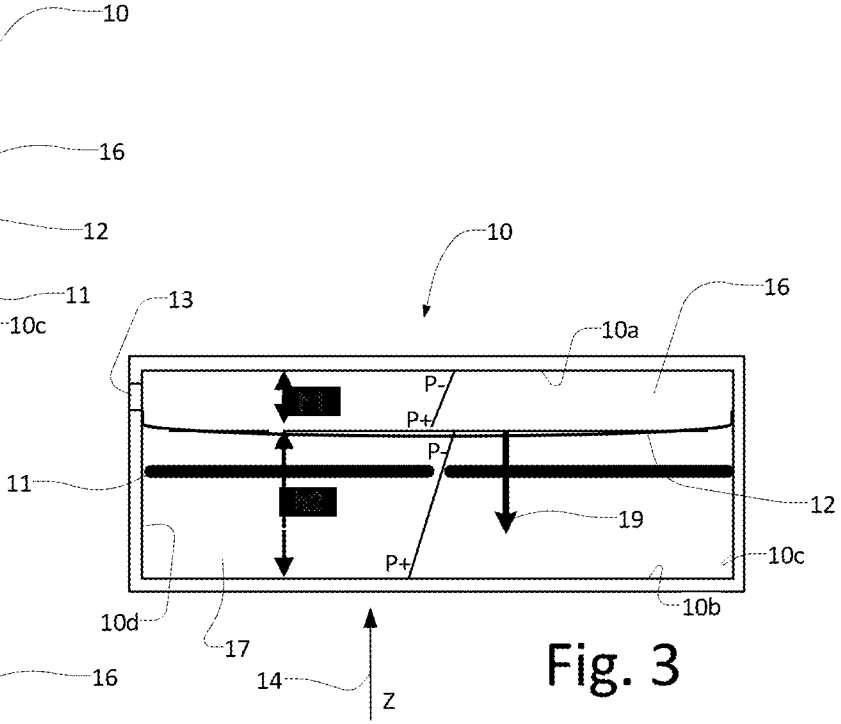
FIG. 3 illustrates the combined pressure build-up in a microphone unit influenced by an acceleration.

The detailed description set forth below in connection with the appended drawings is intended as a description of various configurations. The detailed description includes specific details for the purpose of providing a thorough understanding of various concepts. However, it will be apparent to those skilled in the art that these concepts according to the disclosure may be practiced without these specific details. Several embodiments of the device and methods are described by various functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

An electronic device according to the disclosure preferably includes a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "electronic device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

An electronic device, such as a hearing aid according to the disclosure includes i) an input unit such as a microphone unit for receiving an acoustic signal from a user's surroundings and providing a corresponding input audio signal, and/or ii) a receiving unit, such as a receiver, loudspeaker or speaker, for electronically receiving an input audio signal. The hearing aid further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods.

The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal.

In order to get a better understanding of the importance of extinguishing the sound pressure level (SPL) arising from microphone imperfections, the vibration sensitivity of a microphone will briefly be touched upon in the following with reference to FIGS. 1 to 3.

In general, hearing aid microphone units 10 have the same basic functionality. A charged back plate (i.e. a fixed element) 11 and a dynamic membrane 12 (e.g. a diaphragm, also denoted a movable element) forms a capacitor. When sound enters through the first inlet opening 13 of the microphone unit 10, the pressure from the sound wave forces the membrane 12 to move. The movement of the membrane causes a change in the voltage across the capacitor. Thus, any change in pressure in the volume where the membrane 12 is suspended in a microphone unit 10 causes the membrane 12 to move, why a pressure caused by other sources than a sound pressure level (SPL) from the surrounding environment of the hearing aid when and detected by the microphone unit may create unwanted change in voltage across the capacitor. Various sources causing an unwanted change in output could arise from a vibration acting on the microphone, the vibrations influencing the microphone unit from substantially all directions.

Figure 1:
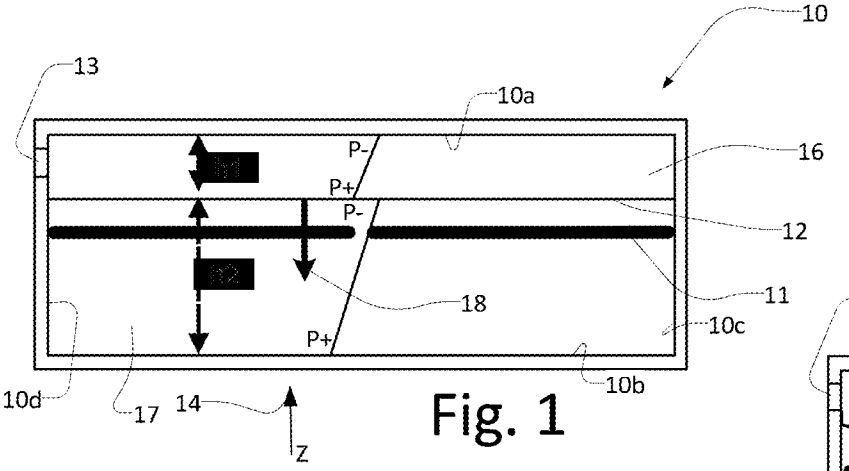
FIG. 1 illustrates schematically a pressure build-up in a microphone unit influenced by an acceleration.
Figure 2:
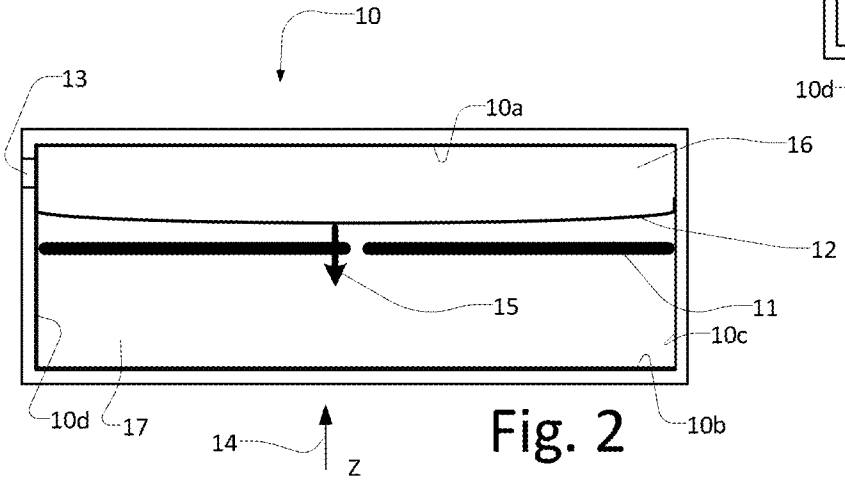
FIG. 2 illustrates schematically the membrane inertia of a microphone unit influenced by acceleration.

A source causing unwanted output signals of the microphone unit 10, is coming from the inertia of the membrane 12, as illustrated in FIG. 2. When the microphone unit 10 moves, for example due to vibrations, the back plate 11 follows, since the back plate 11 is structurally connected to the housing of the microphone unit 10. The membrane 12 does not follow immediately, since the membrane is suspended and the mass of the membrane 12 (i.e a diaphragm) has to be accelerated by a force before it moves. The movement of the membrane 12, due to the force created from the membrane inertia, illustrated in FIG. 2 as arrow 15, is only active when the microphone is vibrated in the direction, in which the membrane 12 can move. The direction of vibration, in which the diaphragm can move is a direction of vibration coming perpendicular to the orientation of the diaphragm, illustrated as the z-direction defined by arrow 14 in FIGS. 1 to 3. The vibration will act on the membrane 12 and potentially cause the membrane 12 to move in the direction shown by arrow 15, resulting in an unwanted charge to the back plate 11 that is not related to a sound pressure level (SPL) caused by the environmental sound and detected by the microphone unit itself. The likely inconsistent and out of phase movement of the membrane 12 and the back plate 11 due to vibrations changes the distance between membrane and back plate, and an output signal is present, even though a sound pressure level (SPL) is not.

Another source to unwanted outputs of the microphone arises due to encapsulated (inerted) air inside the microphone unit 12, illustrated in FIG. 1. When the microphone unit 12 is accelerated in the direction defined by arrow 14, air trapped inside the microphone unit 12 will not move unless being "pushed" by the microphone unit walls 10*a*, 10*b*, 10*c*, 10*d* (or other internal parts). Since this is not symmetric a pressure will build up. The force created due to pressure differences arising from the vibration inside the microphone will act on the membrane 12 in dependence on the pressure-build across the membrane 12.

As an example, illustrated in FIG. 1, a vibration applied to the microphone unit 10 in a direction corresponding to arrow 14, influences air trapped inside first 16 and second 17 chamber. The first chamber 16 has a first volume, the first volume being different than a second volume of the second chamber 17. The two chambers are separated by the movable element 12, also denoted a membrane or diaphragm. The pressure build-up on each sides of the membrane 12 is as shown in FIG. 1 denoted P+, for a substantially positive pressure, and P− for a substantially negative pressure. As seen in FIG. 1, the pressure build-up on each side of the membrane creates a slightly more positive pressure on the side of the membrane facing the first chamber 16, and in relation thereto a slightly lower pressure on the side of the membrane facing the second chamber 17. Therefore, a resulting force created from the pressure difference inside the microphone unit 10 during acceleration thereof, will force the membrane 12 in a direction according to arrow 18 illustrated in FIG. 1. In addition to the pressure build-up inside the microphone unit as illustrated in FIG. 1, a contribution from a pressure build-up in the y-direction will also exist. Thus, a pressure build-up in the substantially longitudinal direction of the microphone from side wall 10*d* to 10*c* is also present and should be accounted for.

The vibrational behaviors of the back plate 11 and the membrane 12 together with vibration of encapsulated air influences the vibration sensitivity of the microphone unit and the combined force, illustrated by arrow 19 in FIG. 3, acting on the membrane during vibrations. The vibrational direction being defined according to arrow 14 results in the membrane moving towards and away from a fixed element, also denoted the back plate 11 of the microphone unit 10. This membrane movement due to vibrations results in a capacitive effect across the electrically charged back plate and essentially an output sound pressure level (SPL) of the microphone unit. The resulting SPL, arising from vibrations influencing the microphone unit are generally identified as the microphones sensitivity towards vibrations. Suppliers of microphone units therefore often provides information on the microphone sensitivity value, such that the correct microphone for a needed implementation can be chosen by a user. Microphones may be build such as to optimize the microphone sensitivity to a specific purpose, and the build-in vibration sensitivity is evaluated, when a microphone is chosen for a specific use.

From considerations, utilizing the in-build microphone vibration sensitivity, realization of the possibility of extinguishing the SPL output of the microphone caused by vibrations of the microphone unit is present. The substantially sufficient extinguishing of unwanted SPL output being obtained by providing a suitable orientation of the microphone unit in relation to an inlet element, where the inlet element extends from a first inlet opening in the microphone unit to a second inlet opening at a wall of a hearing aid housing. The inlet element should be understood to be any type of element, which are able to guide sound from an opening in the hearing aid housing to an opening in the microphone unit. The inlet element could therefore also be termed an inlet guide or sound inlet guide etc.

Different configurations of the microphone unit and the inlet element in relation to each other are illustrated in FIGS. 4 to 9 and will in the following be touched upon for providing a better understanding of the present disclosure.

Figure 4:
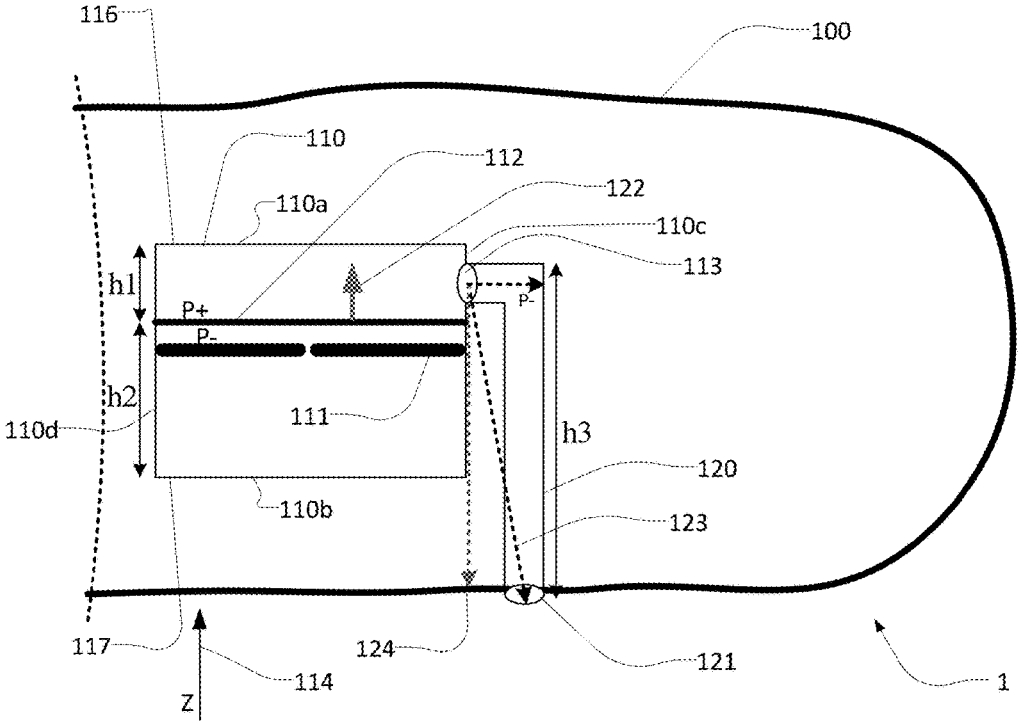
FIG. 4 illustrates a microphone unit and inlet element orientation according to an embodiment of the disclosure, where the housing is influenced by an acceleration at a first point in time.
Figure 5:
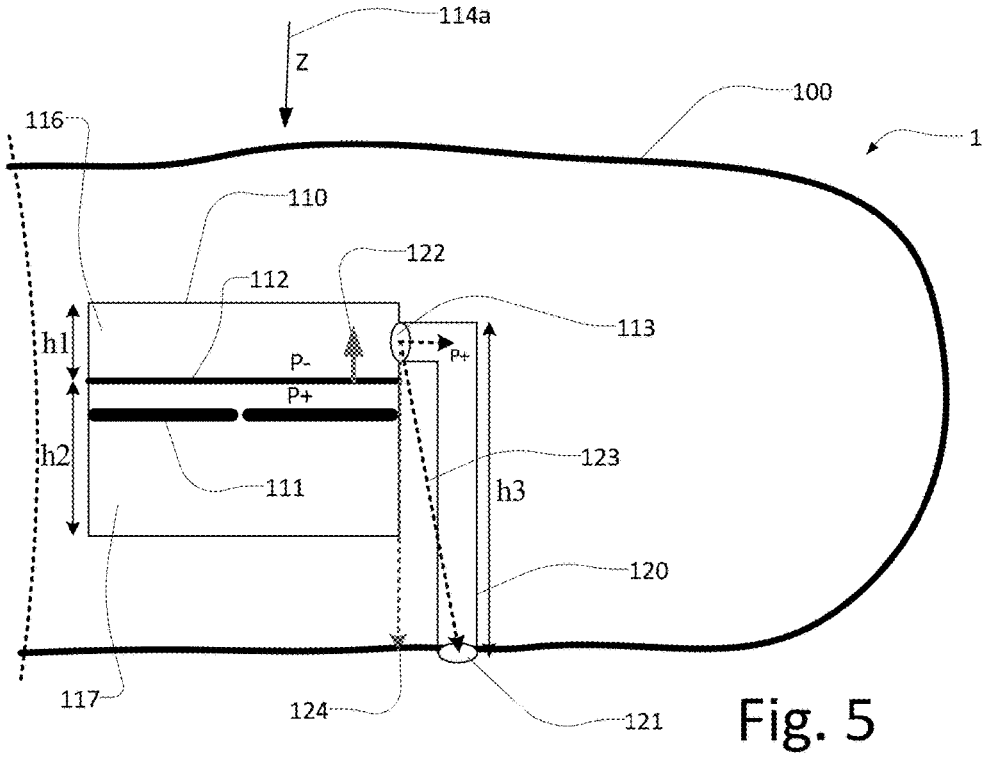
FIG. 5 illustrates the microphone unit and inlet element orientation according to the embodiment of FIG. 4 at a second point in time and under influence by an acceleration.

Referring initially to FIGS. 4 and 5 parts of a hearing aid 1 is illustrated. The hearing aid 1 comprises a housing having an outer wall 100 enclosing a microphone unit 110. The outer wall 100 of the housing separates the microphone unit 110 from an environment. Furthermore, the microphone unit 110 comprises walls 110*a*, 110*b*, 110*c*, 110*d*, which separates the microphone unit from other electronic devices within the hearing aid.

As illustrated in FIGS. 4 and 5, the microphone unit 110 comprises a first chamber 116 having a first volume and a second chamber 117 having a second volume. The first chamber 116 comprises a first height h1 and the second chamber 117 comprising a second height h2. In general, the first and second chamber 116, 117 defines a first and a second volume, which preferably are different.

In addition, a first inlet opening 113 is arranged in the first chamber 116 and a membrane 112 (such as a diaphragm, which is construed as a movable element) is arranged in the microphone unit 110. The diaphragm separates the first 116 and second chamber 117.

Furthermore, a fixed element 111 (such as a charged back plate) is arranged in the microphone unit and provides an electrical charge. Thus, the charged back plate and the diaphragm provides for a capacitive effect of the microphone unit 110 allowing for incoming sound to be processed into an electrical signal, which are further processed by suitable elements, such as circuits, amplifier and speakers (not shown) to account for a hearing loss.

A microphone inlet element 120 is connected to the first chamber 116 at the first inlet opening 113 and to the outer wall 100 of the housing at a second inlet opening 121. In this way, the microphone inlet element is configured to guide sound from the environment (i.e sound delivered to the surface of the hearing aid housing) to the microphone unit 110.

The orientation of the microphone inlet element 120 in relation to the microphone unit 110 is in more detail defined by a microphone unit orientation 122 and an inlet element orientation 123. The microphone unit orientation is defined by a first vector 122, which first vector extends perpendicular to the membrane 112 in a direction from the membrane 112 towards the first inlet opening 113. The inlet element orientation on the other hand is defined by a second vector 123 extending in a direction from the first inlet opening 113 to the second inlet opening 121. As illustrated in the FIGS. 4 and 5 the microphone unit 110 and the inlet element 120, is from this vector direction definition arranged in the housing so that the second vector 123 has at least one component 124 in a direction opposite to the first vector 122.

When the hearing aid housing and accordingly the microphone unit 110 is influenced by a vibration in the direction indicated by arrow 14, the pressure building up inside the microphone unit 110 and the inlet element 120 is in a first static moment in time as illustrated in FIG. 4. As seen in FIG. 4, a positive pressure builds up in the first chamber 116 of the microphone unit 110 and in relation to the pressure in the first chamber, a slightly more negative pressure builds up on the side of the membrane 112 facing the second volume 117. In addition, the inlet element 120 has a pressure build up, which in the static moment in time illustrated in FIG. 4 results in a substantially negative pressure at the end of the inlet element 120, which connects to the first inlet opening 113 of the microphone unit 110. Thus, the resulting pressures build-up at each side of the first inlet opening 113 is of opposite signs, and therefore counteracts each other during vibration of the hearing aid housing. In accordance herewith a pressure, $p_{surface}$ also builds up on the outer walls (i.e. walls facing the environment where sound enters the hearing aid) of the housing. The surface pressure should therefore also be taken into consideration when estimating the pressure building up in the inlet element, as will become apparent in the following.

Depending on the size of the two pressures building up inside the microphone (i.e. the microphone vibration sensitivity explained according to FIGS. 1 to 3) and the pressure building up in the inlet during vibrations, the movement of the membrane 112 caused by the vibrations according to arrow 14, will be substantially counteracted by the pressure building up in the inlet element 120 during vibrations when the inlet element 120 and the microphone unit 110 are arranged in relation to each other as just described.

In a second static moment of time, where the vibration direction defined by arrow 114*a*, is opposite to the one defined in FIG. 4, the microphone unit 110 and the inlet element 120 arranged in accordance with FIG. 4 undergoes a similar pressure build-up. In this case the pressure build-up on each side of the membrane 112 is equal to the one defined in FIG. 4 but of opposite signs, and the pressure build-up in the inlet element is equally of similar pressure, but with opposite sign. Thus, the resulting influence on the membrane is similarly that the positive pressure building up at the first inlet opening 113 in the inlet element 120 counteracts the pressure building up the membrane 112, forcing the membrane to stay in place.

Thus, with a microphone unit and inlet element arranged in relation to each other in the hearing aid according to the configuration just described and in accordance with the following embodiments, it is possible to substantially cancel out the in-build microphone vibration sensitivity of the microphone unit, whereby unwanted sound pressure levels are prevented in the hearing aid.

Accordingly, the microphone unit 110 and the microphone inlet element 120 are arranged relative to each other so that contributions from the microphone unit 110 and the microphone inlet element 120, respectively, to a vibration sensitivity of the microphone when located in the hearing aid, are substantially equal but of opposite sign. Accordingly, the hearing aid construction with a specific inlet element orientation and microphone unit orientation according to the disclosure provides a vibration cancellation which does not require any signal processing, but is merely acoustic in the form of a pressure equalization.

With reference to the concept of arranging the microphone unit 110 and the inlet element 120 in the previously described manner, it is noted that the microphone inlet element 120 in an embodiment, is dimensioned with a height h3, illustrated in FIGS. 4 and 5. The height h3 of the inlet element 120 is defined as a distance from the first inlet opening 113 to the second inlet opening 121. The height is measured along the longitudinal length of the inlet element 120 in a direction parallel with the wall 110*b* of the microphone unit 110.

For providing an optimal counteraction of the pressure building up inside the microphone unit 110 during vibrations, the height h3 of the inlet element 120 is designed by using the following equation;

$$h = \frac{p_{inlet}}{(rho * a_z)},$$

where $p_{inlet}$ is the pressure build-up in the inlet element, rho is the density of air and $a_z$ is an environmental acceleration acting on the housing.

In addition to this calculation, an estimation of the surface pressure $p_{surface}$, on the outer sides exposed to the environment and incoming sound could preferably also be taken into account for achieving an optimal cancellation. Therefore, the surface pressure, should be added to $p_{inlet}$, thus $p_{inlet}=P^{+}+P_{surface}$, where $P^{+}$ is the pressure of the inlet element at the first inlet opening 113, as illustrated in for example FIG. 6. The "+" simply defines whether the pressure at the side of the first inlet element 113 is of negative or positive value, upon influence from a vibration acting on the housing.

Thus, in order to cancel out the vibration sensitivity of the microphone efficiently, the pressure build-up in the inlet element 120 should be of equal size but opposite sign to the pressure build-up in the microphone unit during vibrations. The height of the inlet element may therefore be designed such that the pressure build-up in the inlet is equal to the vibration sensitivity of the microphone unit.

The pressure build-up in the microphone unit 110 can be calculated from the in-build microphone sensitivity value given in dB SPL/g. When knowing the microphone sensitivity value, the pressure in the microphone unit, which the pressure build-up in the inlet element should counteract is calculated, as given in the following example.

If a microphone unit has a given vibration sensitivity on 60 dB SPL/g, this corresponds to a sound pressure of 0.02 Pa/g. Thus the inlet element should be designed such that the pressure, $p_{inlet}$, build up in the inlet element is 0.02 Pa/g. Using the equation, this result in an optimal inlet height of $$h = \frac{0.02\ \text{Pa/g}}{\left(1.204\ \text{kg/m}^3 * \frac{9.81\ \text{m}}{\text{s}^2}\right)} = 1.7\ \text{mm}$$

Thus, for a microphone unit having a vibration sensitivity of 60 dB SPL/g, the inlet height should preferably be 1.7 mm and the inlet element should be arranged in relation to the microphone unit in accordance with the previous description thereof.

In this way, the height of the inlet element is dimensioned such that the contribution from the microphone inlet element, relative to the vibration sensitivity of the microphone unit is of equal size but of opposite sign to the contribution from the microphone unit.

Figure 6:
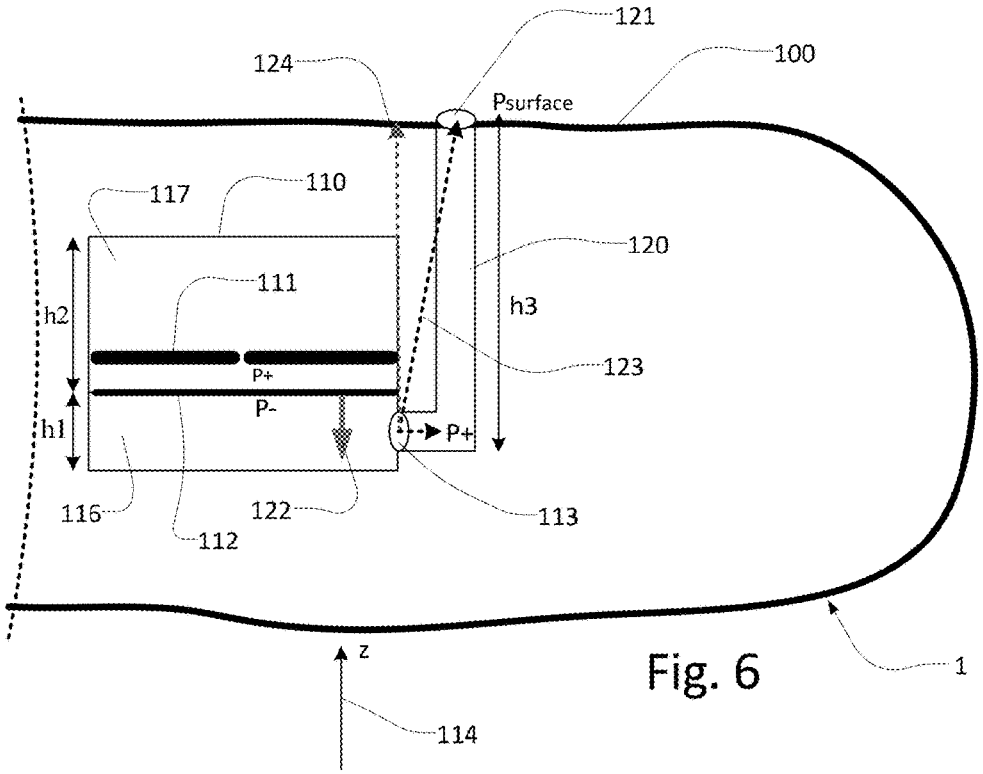
FIG. 6 illustrates another arrangement of a microphone unit and an inlet element in a hearing aid housing according to an embodiment of the disclosure.

Referring now to FIG. 6 in further details, an embodiment according to the disclosure is shown. In general, the microphone unit 110 and the microphone inlet element 120 is arranged and orientated in relation to each other in a manner as previously described. In more detail, the embodiment illustrated in FIG. 6 generally constitutes the same elements and components, i.e. the microphone has a first volume 116 and a second volume 117 and a movable membrane 112 separating the two volumes. Furthermore, the microphone inlet element 120 is in one end connected to the first inlet opening 113 arranged in the microphone unit 110 in the first volume and a second inlet opening 121 connected to a wall 100 of the hearing aid housing. In comparison with FIGS. 4 and 5, the microphone unit 110 and inlet element 120 has been turned 180 degrees in FIG. 6. The embodiments shown in FIGS. 4 to 6 therefore illustrates orientations of the inlet element and the microphone in relation to each other and where the inlet element has been arranged in connection with a first inlet opening provided in the first volume, and which fulfills the requirement of substantially cancelling out the vibration sensitivity according to the disclosure.

As seen from FIG. 6, the microphone unit 110 and microphone inlet element 120 is arranged such that a microphone unit 110 orientation vector 122 extends in an opposite direction to a vector component 124 of an inlet element orientation vector 123 (i.e. the second vector), and this arrangement therefore fulfill the requirements for obtaining a microphone vibration sensitivity cancellation. Accordingly, the optimal inlet height may be calculated as previously described.

Figure 7:
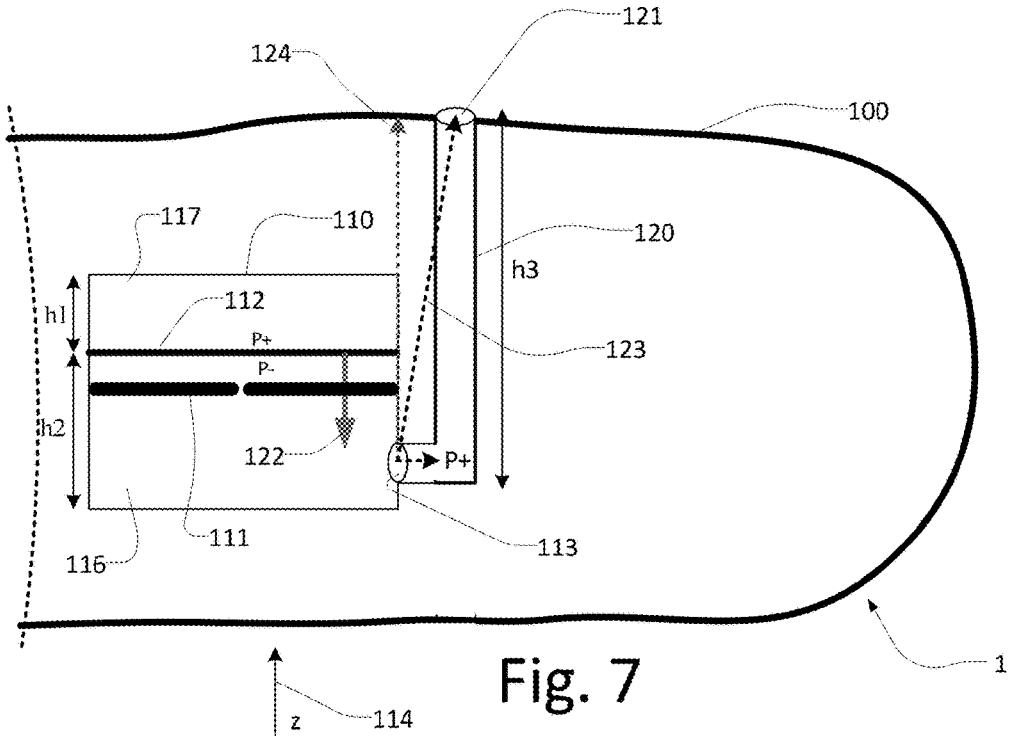
FIG. 7 illustrates an orientation of a microphone unit and an inlet element, according to another embodiment of the disclosure, where the inlet element is arranged in a second chamber having a larger volume than a smaller first chamber.

Referring now to FIG. 7 an embodiment according to the disclosure, where the inlet element 120 is arranged in the second volume, is illustrated. In accordance with the previously described Figures, the first vector 122 extending from the movable membrane 112 towards the first inlet opening 113 is extending in an opposite direction to a vector component 124 defined by the second vector 123, where the second vector indicates the orientation of the inlet element 120. This arrangement will in a similar manner as previously described be able to cancel out the vibration sensitivity of the microphone. The main differences between FIGS. 4 to 6 and 7, is therefore only to illustrate that the inlet element 120 may be provided in both chambers 16, 17 of the microphone unit 110, where at least one of the chambers comprises a volume that is bigger than the other chamber.

Accordingly, and as illustrated in the Figures, the first and second volumes of the microphone unit may be configured such that the second volume of the second chamber is larger than the first volume of the first chamber. However, the volumes could be of the same size.

In general, the first volume, wherein the microphone inlet opening 113 is arranged is defined as a front volume and the larger second volume as a back volume.

As illustrated in the embodiments according to the Figures, the microphone unit further comprises a fixed element 112 (i.e. a back plate), arranged in the microphone unit in one of the first or second chamber substantially parallel to the movable element 111 (i.e. the membrane).

Accordingly, the movable element and the fixed element forms a capacitor within the microphone unit. The capacitive effect of the fixed plate and the membrane creates a voltage inside the microphone unit which is transformed into a signal provided to a receiver which transmit an audible sound signal to the ear drum of the hearing aid user.

The capacitive effect of the fixed plate and the membrane arises due to the movable properties of the membrane and an air gap provided between the fixed element and the movable element, so that a pressure difference across the movable element forces the movable element to move towards and away from the fixed element. When sound waves hits the movable element (i.e. the membrane, also denoted diaphragm), the pressure difference across the membrane forces the membrane to move towards and away from the fixed element whereby a voltage is created.

Accordingly, the movable element is a diaphragm and the fixed element is a back plate, where the back plate in case of an electret-type microphone may hold a static charge so that a voltage is created across the back plate when a pressure difference arises across the diaphragm.

Figure 8:
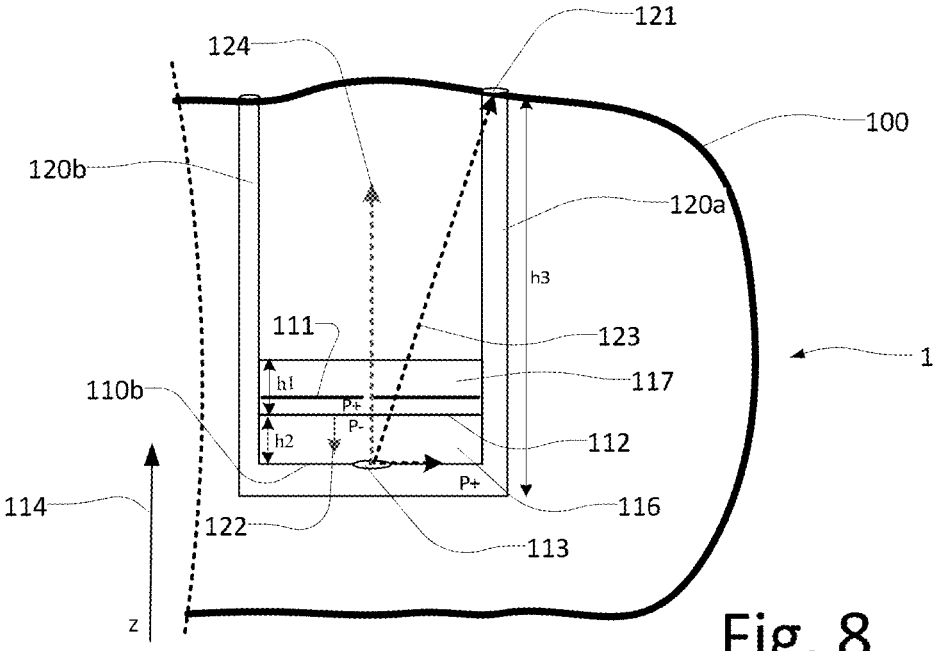
FIG. 8 illustrates another orientation of an inlet element and a microphone unit according to the disclosure.

Referring now to FIG. 8, an embodiment according to the disclosure is illustrated, wherein the microphone unit comprises a first inlet opening 113 in a bottom wall part 110*b* of the microphone unit. Such microphone could for example be of the MEMS type microphone, but should not exclude a similar arrangement with an electret type microphone. The relevance as such does not lie within the microphone type but rather the arrangement of the microphone unit within the housing and in relation to the inlet element.

In the embodiment shown, the microphone unit 110 orientation is defined by the first vector extending in a direction from a movable element 112 towards the first inlet opening 113. In addition, the microphone inlet element 120 extends from the first inlet opening 113 towards a second inlet opening 121 in an outer wall 100 of the hearing aid housing so that a second vector 123 defines the orientation of the inlet element. Thus, in accordance with the previous described figures, the microphone unit 110 and the inlet element 120 are arranged in relation to each other so that the a vector component 124 of the second vector 123 extends in an opposite direction to the first vector 122. This arrangement therefore also fulfills the arrangement requirements for cancelling out the microphone sensitivity.

In the embodiment shown in FIG. 8, the microphone unit 110 is arranged in connection with two microphone inlet elements 120*a*, 120*b*. The microphone inlet opening 113 substantially receives sound from both inlet elements 120*a*, 120*b*. The microphone inlet elements 120*a*, 120*b* could be two separate elements or implemented as one element into which the inlet opening 113 "looks".

Figure 9:
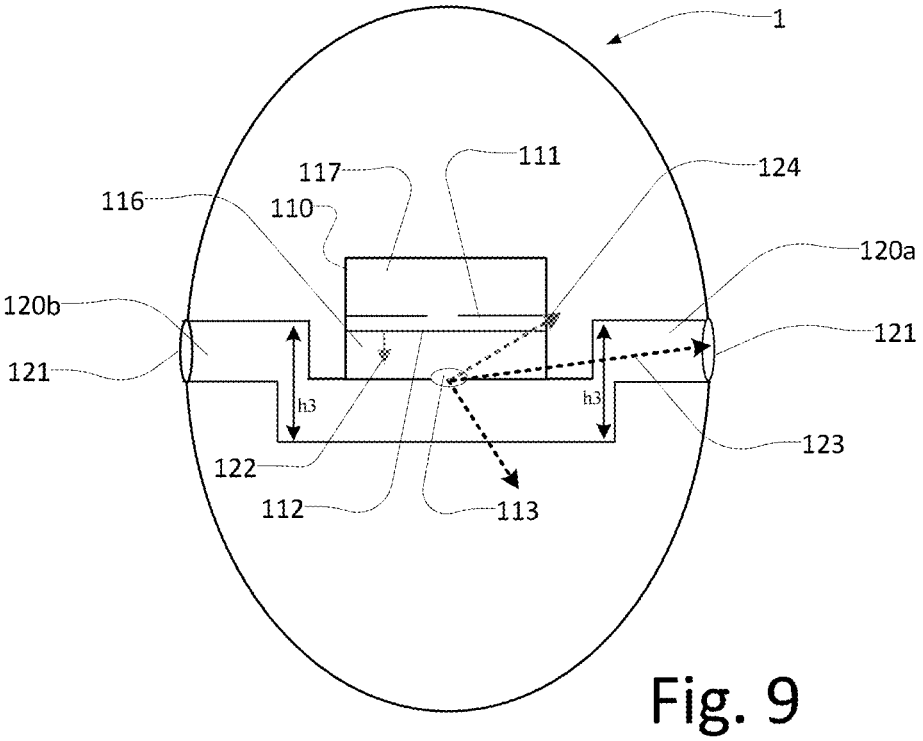
FIG. 9 illustrates a further possible arrangement of an inlet element and a microphone unit according to embodiments of the disclosure.

In a further embodiment illustrated in FIG. 9, a microphone unit 110 is arranged in a hearing aid housing 1, the microphone unit 110 could for example be of a MEMS-type. In this embodiment, the first inlet opening 113 of the microphone unit 110 "looks" into an inlet element comprising a first end 120*a* and a second end 120*b*. In each end 120*a*, 120*b*, a second inlet opening 120 is provided for guiding environmental sounds into the microphone inlet opening 113. In a similar manner as described in relation to the previous embodiments, the inlet element 120*a*, 120*b* comprises a height h3, which may be designed in accordance with the previously described method to efficiently cancel out the microphone vibration sensitivity.

Further, illustrated in FIG. 9 is the arrangement of the microphone unit 110 in relation to the inlet element 120*a*, 120*b* to provide a substantially sufficient microphone vibration cancellation. In a similar manner as previously described the microphone unit orientation is defined by a first vector 122 extending in a direction from a movable element 112 towards the first inlet opening 113. The microphone inlet element 120*a*, 120*b* extends from the first inlet opening 113 towards a second inlet opening 121 in an outer wall of the hearing aid housing 1 so that a second vector 123 defines the orientation of the inlet element (illustrated in relation to inlet element part 120*a* ). Thus, in accordance with the previous described figures, the microphone unit 110 and the inlet element 120*a*, 120*b* are arranged in relation to each other so that the a vector component 124 of the second vector 123 extends in an opposite direction to the first vector 122. This arrangement therefore also fulfills the arrangement requirements for cancelling out the microphone sensitivity.

It is intended that the structural features of the devices described above, either in the detailed description and/or in the claims, may be combined with steps of the method, when appropriately substituted.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid, comprising a housing having an outer wall enclosing at least a microphone unit, the outer wall separating the microphone unit from an environment of the hearing aid, the microphone unit comprising a first chamber having a first volume and a second chamber having a second volume;

a first inlet opening being arranged in the first or second chamber, and a movable element separating the first and second chamber; and a microphone inlet element connected to the first chamber or the second chamber at the first inlet opening and to the outer wall of the housing at a second inlet opening, the microphone inlet element being configured to guide sound from the environment of the hearing aid to the first inlet opening of the microphone unit;

where a microphone unit orientation is defined by a first vector perpendicular to the movable element and extending in a direction from the movable element to the first inlet opening; and where a microphone inlet element orientation is defined by a second vector extending in a direction from the first inlet opening to the second inlet opening;

wherein the microphone unit and the microphone inlet element, are arranged in the housing so that the second vector has a component in a direction opposite to the first vector, allowing an acoustic cancellation of vibrations in the microphone unit of the hearing aid, said acoustic cancellation being provided by said orientation and arrangement of said microphone unit and inlet element causing a pressure equalization.

2. Hearing aid according to claim 1, wherein the second volume of the second chamber is larger than the first volume of the first chamber.

3. Hearing aid according to claim 1, wherein the microphone unit further comprises a fixed element, arranged in the microphone unit in one of the first or second chamber substantially parallel to the movable element.

4. Hearing aid according to claim 1, wherein said microphone unit and said microphone inlet element are arranged relative to each other so that contributions from the microphone unit and the microphone inlet element, respectively, to a vibration sensitivity of the microphone when located in said electronic device, are substantially equal but of opposite sign.

5. Hearing aid according to claim 1, wherein the microphone inlet element is dimensioned with a height, said height being defined as a distance from the first inlet opening to the second inlet opening.

6. Hearing aid according to claim 5, wherein the height of the microphone inlet element fulfills $$h = \frac{p_{inlet}}{(rho * a_z)},$$

where $p_{inlet}$ is the pressure build-up in the inlet element, rho is the density of air and $a_z$ is an environmental acceleration acting on the housing.

7. Hearing aid according to claim 5, wherein the height of the inlet element is dimensioned such that the contribution from the microphone inlet element to the vibration sensitivity of the microphone is equal to, but of opposite sign to the contribution from the microphone unit.

8. Hearing aid according to claim 3, wherein the movable element and the fixed element forms a capacitor within the microphone unit.

9. Hearing aid according to claim 1, wherein an air gap is defined between the fixed element and the movable element, so that a pressure difference across the movable element forces the movable element to move towards and away from the fixed element.

10. Hearing aid according to claim 1, wherein the movable element is a diaphragm and the fixed element is a back plate, the back plate holding a static charge so that a voltage is created across the back plate when a pressure difference arises across the diaphragm.

11. A method for designing a hearing aid optimized for vibration cancellation, comprising the steps of:

i) providing a housing having an outer wall, ii) enclosing a microphone unit in said housing, the outer wall separating the microphone unit from an environment the hearing aid, and the microphone unit comprising a first chamber having a first volume;

a second chamber having a second volume;

a first inlet opening being arranged in the first or second chamber;

a movable element separating the first and second chamber;

iii) connecting a microphone inlet element to the first inlet opening and to the outer wall of the housing at a second inlet opening, wherein the microphone inlet element is configured to guide sound from the environment of the hearing aid to the microphone unit;

where a microphone unit orientation is defined by a first vector perpendicular to the movable element and extending in a direction from the movable element to the first inlet opening; and a microphone inlet element orientation is defined by a second vector extending in a direction from the first inlet opening to the second inlet opening;

iv) arranging the microphone unit and the microphone inlet element in the housing so that the microphone unit and the microphone inlet element, are arranged in the housing so that the second vector has a component in a direction opposite to the first vector, thereby allowing an acoustic cancellation of vibrations in the microphone unit of the hearing aid, said acoustic cancellation being provided by said orientation and arrangement of said microphone unit and inlet element causing a pressure equalization.

12. Method according to claim 11, wherein the inlet element has an optimal height, defined as the distance from the first inlet opening to the second inlet opening, the height fulfilling:

$$h = \frac{p_{inlet}}{(rho * a_z)},$$

where $p_{inlet}$ is the pressure build-up in the inlet element, rho is the density of air and $a_z$ is an environmental acceleration acting on the housing.

13. Method according to claim 11 further comprising the step of v) calculating the optimal height of the inlet element, the optimal height being defined by a height which provides a pressure in the inlet element that are equal but of opposite sign to the vibration sensitivity of the microphone unit when located in said hearing aid.

14. Method according to claim 11, wherein the microphone unit further comprises a fixed element, arranged in the microphone unit in one of the first or second chamber substantially parallel to the movable element.

15. Hearing Aid according to claim 2, wherein the microphone unit further comprises a fixed element, arranged in the microphone unit in one of the first or second chamber substantially parallel to the movable element.

16. Hearing Aid according to claim 2, wherein said microphone unit and said microphone inlet element are arranged relative to each other so that contributions from the microphone unit and the microphone inlet element, respectively, to a vibration sensitivity of the microphone when located in said electronic device, are substantially equal but of opposite sign.

17. Hearing Aid according to claim 3, wherein said microphone unit and said microphone inlet element are arranged relative to each other so that contributions from the microphone unit and the microphone inlet element, respectively, to a vibration sensitivity of the microphone when located in said electronic device, are substantially equal but of opposite sign.

18. Hearing Aid according to claim 2, wherein the microphone inlet element is dimensioned with a height, said height being defined as a distance from the first inlet opening to the second inlet opening.

19. Hearing Aid according to claim 3, wherein the microphone inlet element is dimensioned with a height, said height being defined as a distance from the first inlet opening to the second inlet opening.

20. Hearing Aid according to claim 4, wherein the microphone inlet element is dimensioned with a height, said height being defined as a distance from the first inlet opening to the second inlet opening.

* * * * *